US007982752B2

(12) United States Patent
Lien et al.

(10) Patent No.: US 7,982,752 B2
(45) Date of Patent: Jul. 19, 2011

(54) MULTI-FORMAT IMAGE DISPLAY APPARATUS AND METHOD

(75) Inventors: Chi-chin Lien, Taipei (TW); Ting-hsun Wei, Tianan Hsien (TW); Hui-cheng Hsu, Baoshan Township, Hsinchu County (TW)

(73) Assignee: Mediatek Inc., Hsin-Chu (TW)

( * ) Notice: Subject to any disclaimer, the term of this patent is extended or adjusted under 35 U.S.C. 154(b) by 576 days.

(21) Appl. No.: 12/180,952

(22) Filed: Jul. 28, 2008

(65) Prior Publication Data

US 2010/0020105 A1 Jan. 28, 2010

(51) Int. Cl.
*G09G 5/00* (2006.01)

(52) U.S. Cl. ..... 345/660

(58) Field of Classification Search ..... 345/660, 345/667

See application file for complete search history.

(56) References Cited

U.S. PATENT DOCUMENTS

| | | | | |
|---|---|---|---|---|
| 6,069,607 | A * | 5/2000 | Everett et al. | 345/660 |
| 6,654,026 | B2 * | 11/2003 | Lee | 345/600 |
| 2002/0021273 | A1 * | 2/2002 | Lee | 345/88 |

* cited by examiner

*Primary Examiner* — Ryan R Yang
(74) *Attorney, Agent, or Firm* — Kirton & McConkie; Evan R. Witt

(57) ABSTRACT

An image display apparatus and method are disclosed. In the present invention, image frames of various data information sizes are displayed with a selected output data information size. If the selected output data information size is below a limit of a storage medium for buffering image frames to be displayed, the data information size of an input image frame is adjusted to the output data information, and the image frame is displayed in the output data information size. If the output data information exceeds the limit of the storage medium, the input image is over-compressed to have a lower data information size. Then an image processing is performed to the image frame, so that the processed image frame is decompressed to have the output data information size before being displayed. Therefore, the decompressed image frame can be displayed in the selected output data information size.

22 Claims, 4 Drawing Sheets

MULTI-FORMAT IMAGE DISPLAY APPARATUS AND METHOD

TECHNICAL FIELD OF THE INVENTION

The present invention relates to image display, more particularly, to an apparatus and method for displaying image frames of various formats with a predetermined data information size.

BACKGROUND OF THE INVENTION

As image displaying techniques are rapidly developed, more and more display interfaces such as television (TV) sets and computer screens have upgraded to support high definition (HD) display in addition to standard definition (SD) display. That is, there are multi-format display interfaces which are capable of supporting displaying of various data information sizes available currently. To display image frames of different data information sizes on the multi-format display interface becomes an important issue.

Taking TV display as an example, image frames of resolution formats 480i (dimension: 720×480), 576i (dimension: 720×576), 480p (dimension: 720×480), and 576p (dimension: 720×576) are classified as SD formats. Images frames of resolution formats 720p (dimension: 1280×720) and 1080i (dimension: 1920×1080) and 1080p (dimension: 1920×1080) are classified as HD formats, in which 1080p is referred to "full HD". The character "i" indicates "interlace", means that a frame is divided into two fields to be output at two time points. The character "p" indicates "progressive", means that a frame is scanned line by line and output at a time. As known, the progressive display scheme needs a bandwidth which is almost double as compared to that required by the interface scheme. The dimension of an image frame of 200 million pixels is about the same as full HD.

For an image output device such as a digital camera, the dimension of the output image frame is of the order of millions of pixels, or even higher. In addition, the image frame which meets the standard of blu-ray disc (BD) or HDTV is at the grade of HD format. To display high-resolution images of various formats on the display interface (e.g. a TV set) with a selected resolution, flexible and adaptable adjustment of resolution to the image is required.

SUMMARY OF THE INVENTION

The present invention is to provide an image display apparatus, which is adaptive and flexible to display image frames of various data information sizes in a selected output data information size. In addition, the present invention also provides an image display method performed in the image display apparatus. If the selected output data information size is below a maximum data information size limit of a storage medium for buffering image frames to be displayed, the data information size of an input image frame is adjusted directly to the output data information size, and the image frame is then displayed in the output data information size. However, if the output data information size exceeds the maximum data information size limit of the storage medium, the input image frame is first over-compressed to have a data information size lower than the limit of the storage medium, so that the compressed image frame can be buffered in the storage medium. Then an image processing is performed to the image frame, so that the processed image frame is decompressed to have the output data information size before being displayed. Then the decompressed image frame can be displayed in the selected output data information size.

In accordance with the present invention, the image display apparatus comprises a multi-format display interface for determining format and data information size of an image frame and display the image frame in a selected output data information size; a storage medium having a limit of maximum data information size that the storage medium being capable to support; and an adjusting unit for receiving an input image frame having a data information size and performing a lossy adjustment on the input image frame to generate an adjusted image frame. The adjusted image frame is generated to have an intermediate data information size which is lower than the output data information size if the selected output data information size exceeds said limit of the storage medium, otherwise the adjusted image frame is generated to have the selected output data information size. The adjusted image is stored in the storage medium. The image apparatus further has a processing unit for performing image processing on said adjusted image frame having the intermediate data information size to retrieve the adjusted image thereby generating a processed image frame having the selected output data information size.

The image display apparatus in accordance with the present invention further comprises a controller for determining whether the selected output data information size exceeds the limit of the storage medium and controlling the adjusting unit to perform the lossy adjustment on the input image frame to generate the adjusted image frame to have the selected output data information size or the intermediate data information size according to the determination result.

The image display method in accordance with the present invention comprises receiving an input image frame; performing a lossy adjustment on the input image frame to generate an adjusted image frame; storing said adjusted image frame; performing image processing on the adjusted image to generate a processed image frame. The adjusted image frame is generated from the input image frame to have an intermediate data information size which is lower than the output data information size if the output data information size exceeds the limit for storing image frame. Otherwise, the adjusted image frame is generated to directly have the output data information size. In this case, the step of image processing is omitted. Depending on whether a selected output data information size exceeds a data information size limit for storing image frames to be displayed by a storage medium, one of the adjusted image and the processed image is selected to displayed in the output data information size.

BRIEF DESCRIPTION OF THE DRAWINGS

The present invention will be further described in details in conjunction with the accompanying drawings.

DETAILED DESCRIPTION OF THE INVENTION

Figure 1:
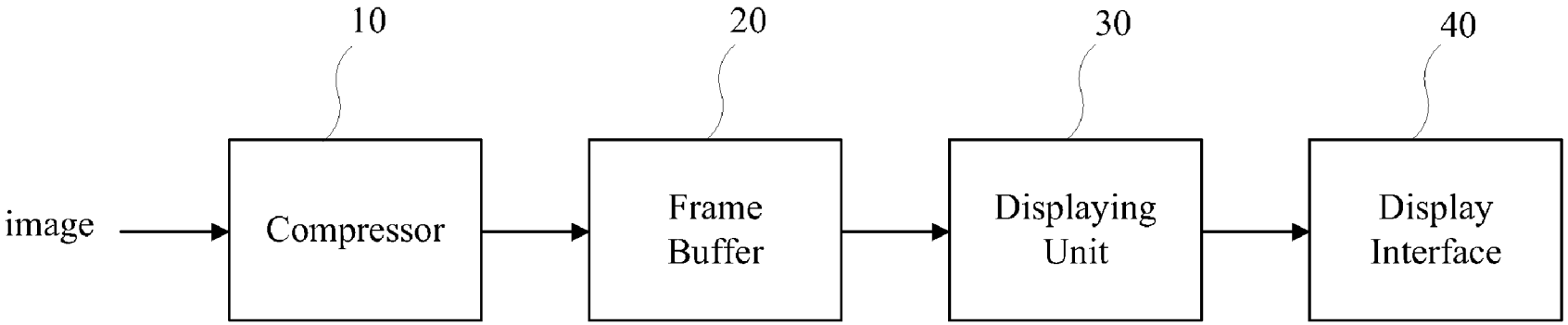
FIG. 1. is a block diagram schematically and generally illustrating an image display apparatus in accordance with an embodiment of the present invention.

FIG. 1 schematically and generally shows a basic structure of an image display apparatus in accordance with the present invention. The image display apparatus comprises an adjusting unit for performing an adjustment on an input image frame. It may be a lossy adjustment. The adjusting unit is implemented by a compressor 10 in the present embodiment. The apparatus further has a storage medium such as a frame buffer 20, a displaying unit 30 and a display interface 40. An image frame having a specific data information size is to be displayed on the display interface 40 with a designated output resolution. Preferably, the display interface 40 is capable of supporting multiple formats such as various SD and HD formats. For brevity, the resolution is used to explain the data information size for the following embodiments. However, this should not be taken as the limitation of the present invention. The data information should be taken to the sense of public understand for one who worked in the relevant field. If the resolution of the input image frame is greater than the output resolution, which is set by the display interface 40 for the purpose of displaying the image, the image is compressed by the compressor 10 into a compressed image frame to correspond with the output resolution. The compressed image frame is buffered in the frame buffer 20 and then processed into display signals by the displaying unit 30. The display signals are transmitted to the display interface 40 so that the display interface 40 can display the image frame with the selected output resolution.

To display an image frame in 480p format, the required bandwidth is about 720×480×60×1.5=31.1 MB/s, wherein 60 indicates the displaying frequency of 60 Hz, that is, 60 frames are displayed per second; the multiplier 1.5 indicates that 1 byte data is used to indicate brightness and 0.5 byte data is used to indicate chroma for each point. Similarly, to display the image frame in 576p format, the required bandwidth is about 720×480×50×1.5=31.1 MB/s. To display the image frame in 720p format, the required bandwidth is about 1280×720×60×1.5=82.9 MB/s. To display the image frame in 1080i format, the required bandwidth is about 1920×540×60×1.5=93.3 MB/s. To display the image frame in 1080p format, the required bandwidth is about 1920×1080×60×1.5=186.6 MB/s.

In practice, for example, the frame buffer 20 is implemented by an SDRAM, which is usually separately provided on a chip and shared by other operations. It is assumed that a single 16 bit SDRAM operating at 133 MHz is used as the frame buffer 20. In addition, the usage efficiency of the SDRAM is 60%. Then, the bandwidth that the frame buffer 20 is capable to support is 133×2×60%=159.6 MB/s, which is lower than the bandwidth required by 1080p format. Therefore, if the output resolution is selected as 1080p, the input image frame needs to be compressed to an intermediate resolution that the frame buffer 20 is able to support. The intermediate resolution is lower than the output resolution. The intermediate resolution is preferably set to be as close as possible to the maximum resolution limit that the frame buffer 20 is capable of supporting. This is because the more the image frame is compressed, the more information may be lost, results in distortion of the image frame.

Since the input image frame is over-compressed to adjust the resolution thereof into a lower resolution, an additional image processing operation is required to decompress the compressed image frame into a processed image with the output resolution. Accordingly, the processed image frame can be displayed on the display interface 40 via the displaying unit 30 in the predetermined output resolution.

Figure 2:
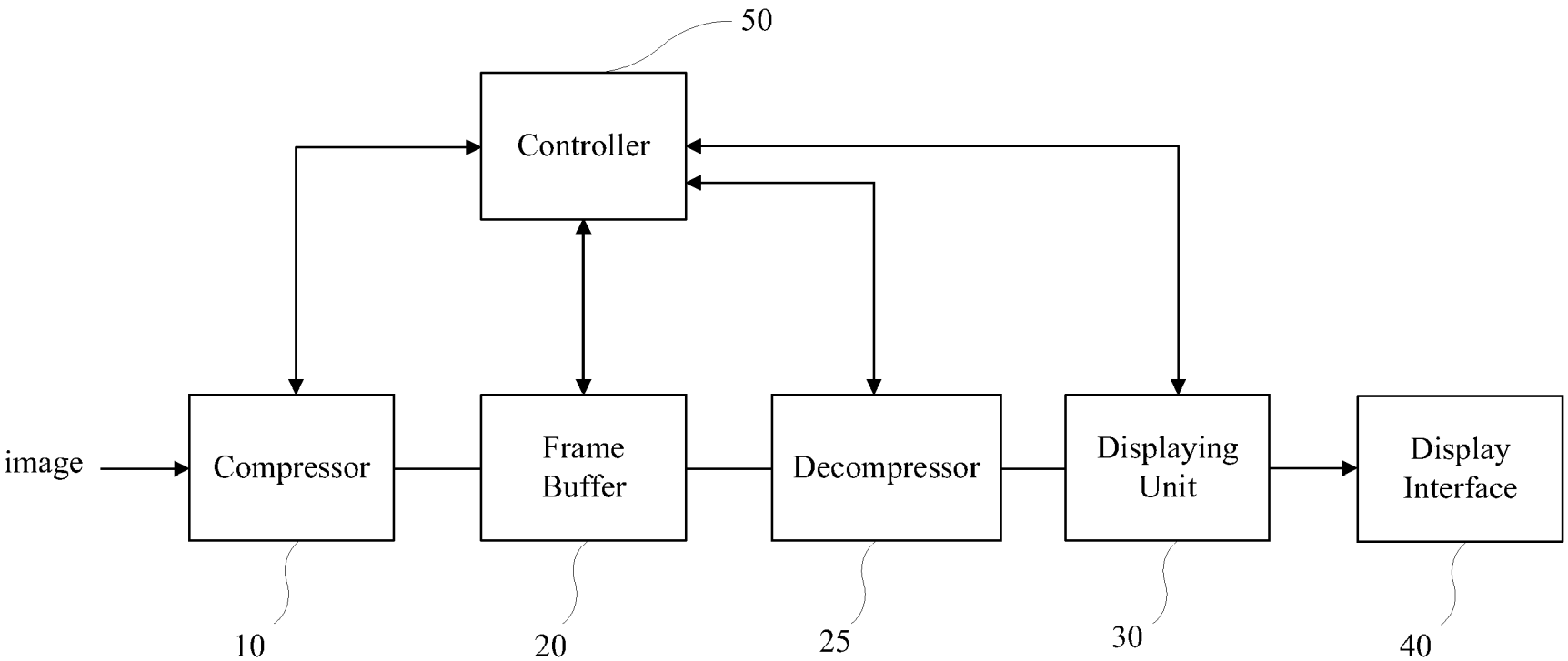
FIG. 2. is a block diagram schematically and generally illustrating an image display apparatus in accordance with another embodiment of the present invention.

FIG. 2. is a block diagram schematically and generally illustrating an image display apparatus in accordance with another embodiment of the present invention. In addition to the components the same as those in FIG. 1, the image display apparatus of FIG. 2 further comprises a processing unit such as a decompressor 25 provided between the frame buffer 20 and displaying unit 30. An incoming image frame with a high resolution is over-compressed under taking account of the bandwidth limit of the frame buffer 20. The over-compressed image frame is then stored in the frame buffer 20. The decompressor 25 performs image processing such as scaling to decompress the image frame from the frame buffer into the processed image frame. The process image frame has a resolution the same as the output resolution. The displaying unit 30 converts the processed image frame into display signals. The display interface 40 receives the display signals from the displaying unit 30 and displays an output image frame in the output resolution accordingly.

In the present embodiment, the image display apparatus further has a controller 50 for controlling the compressor 10 to compress the incoming image according to the limit conditions of the frame buffer 20. In addition to the bandwidth limit mentioned above, the capacitance of the frame buffer 20 may be forcibly allocated so that only a limited portion of the throughput is available for buffering the compressed image. For example, an external command can be given the to controller 50 so that the controller 50 controls the compressor 10 to compress the image frame into a specific intermediate resolution according to the command. The controller 50 determines if the selected output resolution that the image frame is to be displayed on the display interface 40 exceeds the limit of the frame buffer 20. The limit of the frame buffer 20 is estimated by the controller 50. Alternatively, various limits of the frame buffer 20 are calculated in advance and stored in a table. The controller 50 looks up the table to obtain a proper limit under current conditions when making determination. If the selected output resolution does not exceed the limit of the frame buffer 20, the controller 50 instructs the compressor 10 to compress the input image frame to the output resolution directly. The compressed image frame is then buffered in the frame buffer 20. The controller 50 controls the image frame to bypass the decompressor 25 to be processed by the displaying unit 30. Alternatively, the controller 50 instructs the decompressor 25 not be execute decompression to the image frame in this case. If the selected output resolution exceeds the limit of the frame buffer 20, the controller 50 controls the compressor 10 to over-compress the input image frame. The degree of over-compression depends on the limit of the frame buffer 20 and the selected output resolution. In this case, the controller 50 further controls the decompressor 25 to retrieve the buffered image frame, which has been over-compressed to have the intermediate resolution, into the processed image frame with the output resolution. As described, the output resolution is supported by the displaying unit 30 and the display interface 40. The controller 50 can be implemented by a program executed in a processor (not shown).

In the above embodiments, the lossy adjustment and image processing executed on the image frame in order to change the resolution thereof are implemented by compression and decompression, respectively. It is preferred that the compression and decompression are implemented by scaling the dimension of the image frame. More particularly, the image frame is zoomed into a smaller size so that the resolution thereof is decreased, and then is zoomed into a larger size so that the resolution thereof is increased. However, other compression/decompression schemes can also be used, such as interpolation/decimation, up-scaling/down-scaling, frequency domain transform quantization, and other zooming techniques known to the one who worked in the relevant art.

Figure 3:
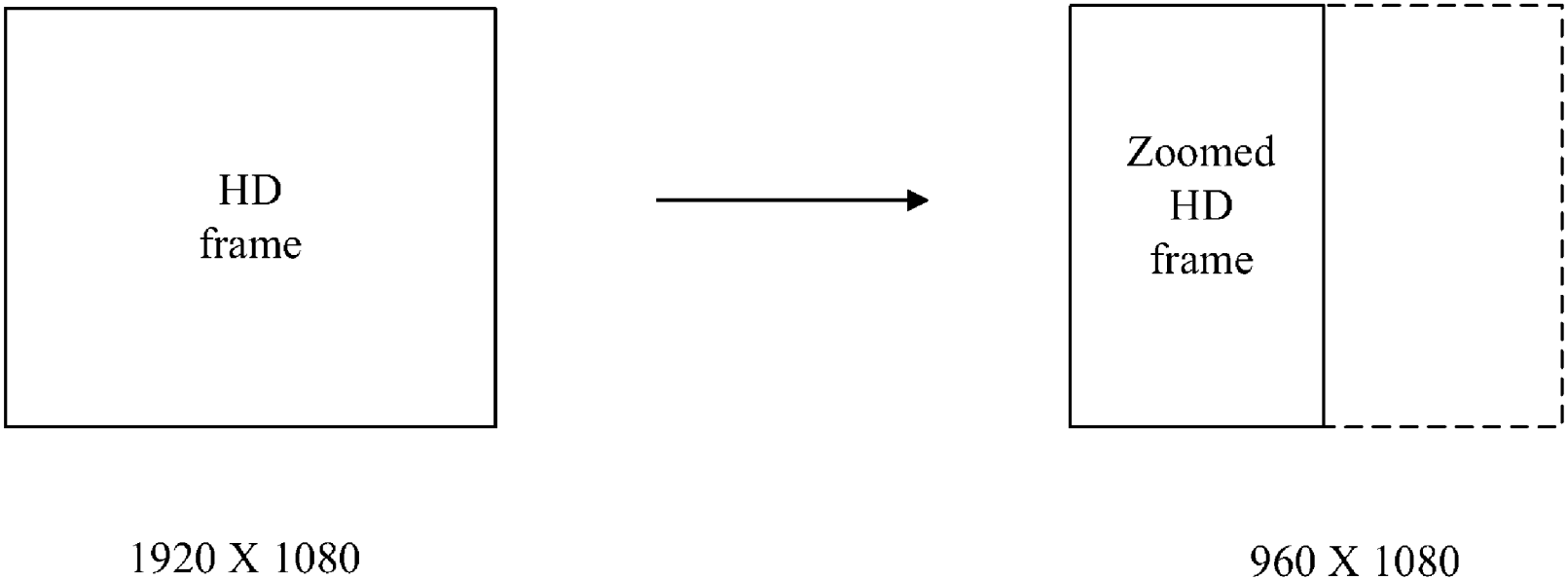
FIG. 3 schematically shows a scaling scheme used to compress an image frame in the present invention.
Figure 4:
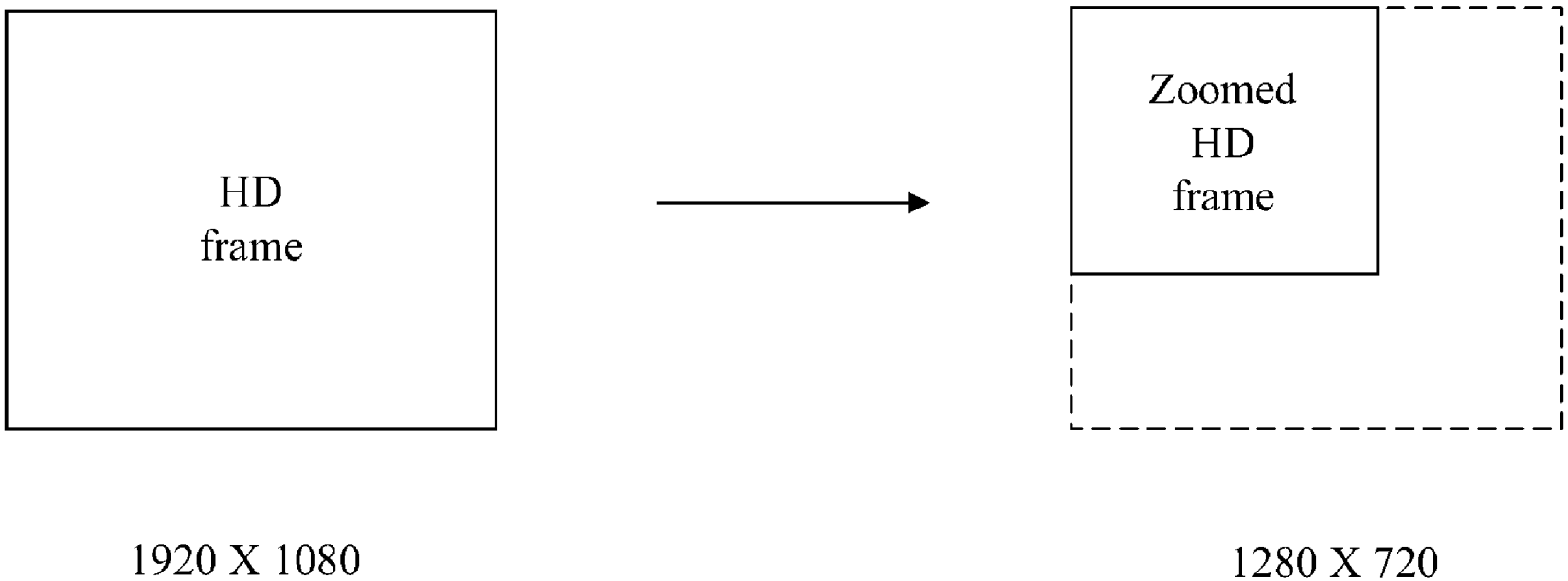
FIG. 4 schematically shows another scaling scheme used to compress an image frame in the present invention

FIGS. 3 and 4 respectively show two different image scaling methods. To compress the image by zooming, an HD image frame can be zoomed in only one direction such as the horizontal direction. As shown in FIG. 3, the image frame of dimension 1920×1080 is zoomed in the horizontal direction into a zoomed HD frame of dimension 960×1080. It is noted that the image frame can also be zoomed in the vertical direction. The compressed image frame zoomed in the single direction by the compressor 10 is zoomed in the same direction to be decompressed by the decompressor 25, if necessary. In addition to scaling the dimension of the image in a single direction, the compression can also be done in both horizontal and vertical directions. As shown in FIG. 4, the HD image frame of dimension 1920×1080 is zoomed in both horizontal and vertical directions to be a compressed image frame of dimension 1280×720. Similarly, the decompression is also executed in both directions.

While the preferred embodiment of the present invention has been illustrated and described in details, various modifications and alterations can be made by persons skilled in this art. The embodiment of the present invention is therefore described in an illustrative but not in a restrictive sense. It is intended that the present invention should not be limited to the particular forms as illustrated, and that all modifications and alterations which maintain the spirit and realm of the present invention are within the scope as defined in the appended claims.

What is claimed is:

1. An image display apparatus for adaptively adjusting data information size of an input image frame according to an image frame having a specific data information, said apparatus comprising:

a multi-format display interface for displaying the image frame in a first data information;

a storage medium having a limit of maximum data information size that the storage medium being capable to support;

an adjusting unit for receiving an input image frame having a second data information size and performing an adjustment on the input image frame to generate an adjusted image frame, the adjusted image frame being generated to have a third data information size, wherein the third data information size is set to be lower than the first data information size if the first data information size exceeds said limit of the storage medium, otherwise, the third data information size is set to be equal to the first data information size; and a processing unit for performing an image processing on the adjusted image frame having the third data information size from the storage medium to generate an processed image frame corresponding to the first data information size.

2. The apparatus of claim 1, wherein the multi-format display interface displays the adjusted image frame having the first data information size directly if the first data information size does not exceed the limit of the storage medium.

3. The apparatus of claim 2, wherein the processing unit is bypassed if the first data information size does not exceed the limit of the storage medium.

4. The apparatus of claim 1, wherein the limit of the storage medium is determined based on efficiency of bandwidth of the storage medium.

5. The apparatus of claim 1, wherein the limit of the storage medium is determined based on the size of the storage medium.

6. The apparatus of claim 1, wherein the data information size is referred to the resolution of the data information.

7. The apparatus of claim 1, wherein the adjustment comprises compression.

8. The apparatus of claim 7, wherein the compression is implemented by decimation, down-scale, frequency-domain compression transforming quantization, or other compression zooming techniques.

9. The apparatus of claim 1, wherein the image processing comprises decompression.

10. The apparatus of claim 9, wherein the decompression is implemented by interpolation, up-scaling, or other decompression zooming techniques.

11. The apparatus of claim 1, further comprising a controller for determining whether the first data information size exceeds the limit of the storage medium and controlling the adjusting unit to perform the lossy adjustment on the input image frame to generate the adjusted image frame having the first data information size or the third data information size according to the determination result.

12. The apparatus of claim 9, wherein the controller determines the third data information size based on efficiency for bandwidth of the storage medium.

13. The apparatus of claim 9, wherein the controller determines the third data information size based on an external command given to the controller.

14. The apparatus of claim 9, wherein the controller is implemented by a readable program.

15. An image display method for adaptively adjusting data information size of an image frame, said method comprising steps of:

receiving an input image frame;

performing an adjustment on the input image frame to generate an adjusted image frame;

storing said adjusted image frame;

performing image processing on the adjusted image to generate a processed image frame;

displaying one of the adjusted image and the processed image in a first data information size, wherein the input image frame has a second data information size, the adjusted image frame is generated from the input image frame to have a third data information size which is lower than the first data information size if the first data information size exceeds a limit for storing image frame, otherwise, the adjusted image frame is generated to have the first data information size.

16. The method of claim 15, wherein the adjusted image frame having the first data information size is displayed directly if the first data information size does not exceed the limit for storing image frame.

17. The method of claim 15, wherein the image processing is bypassed if the first data information size does not exceed the limit of for storing image frame.

18. The method of claim 15, wherein the limit for storing image frame is determined based on efficiency of bandwidth of a storage medium used for storing the adjusted image frame.

19. The method of claim 15, wherein the limit for storing image frame is determined based on the size of a storage medium used for storing the adjusted image frame.

20. The method of claim 15, further comprising determining whether the first data information exceeds the limit for storing image frame and controlling the adjustment to be performed on the input image frame to generate the adjusted image frame having the first data information or the third data information according to the determination result.

21. The method of claim 15, wherein the third data information size is determined based on efficiency of bandwidth of a storage medium used for storing the adjusted image frame.

22. The method of claim 15, wherein the third data information is determined based on an external command.

* * * * *